US008234976B2

(12) United States Patent
Harr

(10) Patent No.: US 8,234,976 B2
(45) Date of Patent: Aug. 7, 2012

(54) DEVICE AND METHOD FOR COMPRESSING WOOD

(75) Inventor: Per Erik Harr, Rognan (NO)

(73) Assignee: Rognan Bioenergi AS, Rognan (NO)

( * ) Notice: Subject to any disclaimer, the term of this patent is extended or adjusted under 35 U.S.C. 154(b) by 602 days.

(21) Appl. No.: 12/278,782

(22) PCT Filed: Feb. 14, 2007

(86) PCT No.: PCT/NO2007/000050

§ 371 (c)(1),
(2), (4) Date: Oct. 14, 2009

(87) PCT Pub. No.: WO2007/094682

PCT Pub. Date: Aug. 23, 2007

(65) Prior Publication Data

US 2010/0018414 A1 Jan. 28, 2010

(30) Foreign Application Priority Data

Feb. 16, 2006 (NO) ..... 20060757

(51) Int. Cl.
*B65B 13/20* (2006.01)

(52) U.S. Cl. ..... 100/3; 100/26; 100/29; 100/233

(58) Field of Classification Search ..... 100/1, 3, 100/7, 8, 9, 25, 26, 29, 32, 233; 53/529, 53/590

See application file for complete search history.

(56) References Cited

U.S. PATENT DOCUMENTS

| | | | | | |
|---|---|---|---|---|---|
| 577,611 | A * | 2/1897 | Berres | 100/7 |
| 682,848 | A * | 9/1901 | Greene | 100/257 |
| 995,939 | A * | 6/1911 | Anderson | 53/526 |
| 1,177,168 | A * | 3/1916 | Borbash | 100/1 |
| 3,939,762 | A | 2/1976 | Smitherman | |
| 4,072,094 | A | 2/1978 | Smitherman | |
| 4,463,667 | A * | 8/1984 | Jones | 100/2 |
| 4,467,712 | A | 8/1984 | Fincham | |
| 5,243,901 | A * | 9/1993 | Green | 100/7 |
| 2004/0211327 | A1* | 10/2004 | Bock | 100/8 |
| 2005/0145115 | A1 | 7/2005 | Garcia | |

FOREIGN PATENT DOCUMENTS

| | | |
|---|---|---|
| DE | 19909322 | 9/1999 |
| EP | 1438888 | 7/2004 |
| EP | 1563726 | 8/2005 |
| JP | 200012135200 | 8/2001 |
| WO | 97/42085 | 11/1997 |

* cited by examiner

*Primary Examiner* — Jimmy T Nguyen
(74) *Attorney, Agent, or Firm* — Christian D. Abel

(57) ABSTRACT

A device for compressing wood is formed as a container (10) with a bottom plate (12) and a longitudinal side plate (14). A first compression arrangement (40) in the form of a compression plate (48) attached to a number of moving devices (42) which are rotatable about a spindle (44) in the longitudinal side plate (14) carries out compression of the wood in a first direction. A second compression arrangement (30) in the form of a compression plate (38) attached to a number of moving devices (32) which are rotatable about a spindle (34) in the bottom plate (12), carries out compression of the wood in a second direction. The device (1) further includes a bundling arrangement (60) comprising a stay (62) with a retainer body (67) for securing a strap from a strap drive device (64) around the compressed wood.

7 Claims, 3 Drawing Sheets

DEVICE AND METHOD FOR COMPRESSING WOOD

CROSS REFERENCE TO RELATED APPLICATIONS

This application is a National Stage application of PCT/NO07/00050, filed on Feb. 14, 2007.

TECHNICAL FIELD

The present invention relates to a device and a method for compressing wood. The invention also relates to bundling the compressed wood for easy and efficient transport.

PRIOR ART

There are a number of compressing devices for compressing wood. It is common practice in forestry today for the twigs to be lopped off the timber at the felling site before the log is driven away for further processing. Branches and twigs are often left lying in the forest.

Today there is a wish to utilise residual wood, such as branches and twigs, for example, as biofuel, or it can be shredded to form energy chips or pellets.

The publication DE 19909332 discloses a device for packing trees, branches and other plant material into a compressed state. The packing and compressing take place directly on a pallet, where a first vertical surface is pressed against another vertical surface. The device forms a substantial part of a trailer. The disadvantage of this device is that it is large and heavy, and a separate vehicle is required to transport it. In addition, empty pallets also have to be conveyed to the packing site.

The publication WO 97/42085 discloses a machine for packing Christmas trees on a pallet. In this case too the trees undergo a certain degree of compression before being bundled together on the pallet. The object here is to keep the trees in good condition during compression, and this makes different demands on the technical equipment.

The publication EP 1 438 888 discloses a machine for recycling rubbish as well as forest and agricultural waste. The waste is cut up and compressed by means of hydraulic pressure and packed into bales by means of wire. The machine is mounted on the load platform of a lorry, and is also large and heavy, requiring a separate vehicle.

It is an object of the present invention to provide a device and a method for compressing wood which overcomes the drawbacks of the prior art.

SUMMARY OF THE INVENTION

The present invention relates to a device for compressing wood, comprising:

a container (10) with a bottom plate (12) and a longitudinal side plate (14);

first compression means (40) comprising a first compression plate (48) attached to a number of first moving devices (42) which are rotatable about a spindle (44) in the longitudinal side plate (14), where the first compression means (40) carries out compression of the wood in a first direction;

second compression means (30) comprising a second compression plate (38) attached to a number of second moving devices (32) which are rotatable about a spindle (34) in the bottom plate (12), where the second compression means (30) carries out compression of the wood in a second direction; where a number of slots (21) are provided in the container (10), a number of slots (49) in the first compression means (30) and a number of slots (39) in the second compression means (40), where the slots (21, 39, 49) are located in the same plane across the container's (10) longitudinal axis (I-I); and where the device (1) further comprises:

bundling means (60) for applying and fastening a strap round the compressed wood through respective slots (21, 39, 49).

The present invention also relates to a method for compressing wood, comprising:

filling wood in a container (10) with a bottom plate (12) and a longitudinal side plate (14);

compressing the wood in a first direction by means of first compression means (40) comprising a compression plate (48) attached to a number of moving devices (42), by rotating the first compression means (40) about a spindle (44) in the longitudinal side plate (14);

compressing the wood in a second direction by means of second compression means (30) comprising a compression plate (38) attached to a number of moving devices (32), by rotating the second compression means (30) about a spindle (34) in the bottom-plate (12); and applying and fastening straps round the compressed wood.

Preferred embodiments of the invention are defined in the dependent patent claims.

DETAILED DESCRIPTION OF THE INVENTION

The present invention will now be described with reference to the attached drawings, in which.

Figure 1:
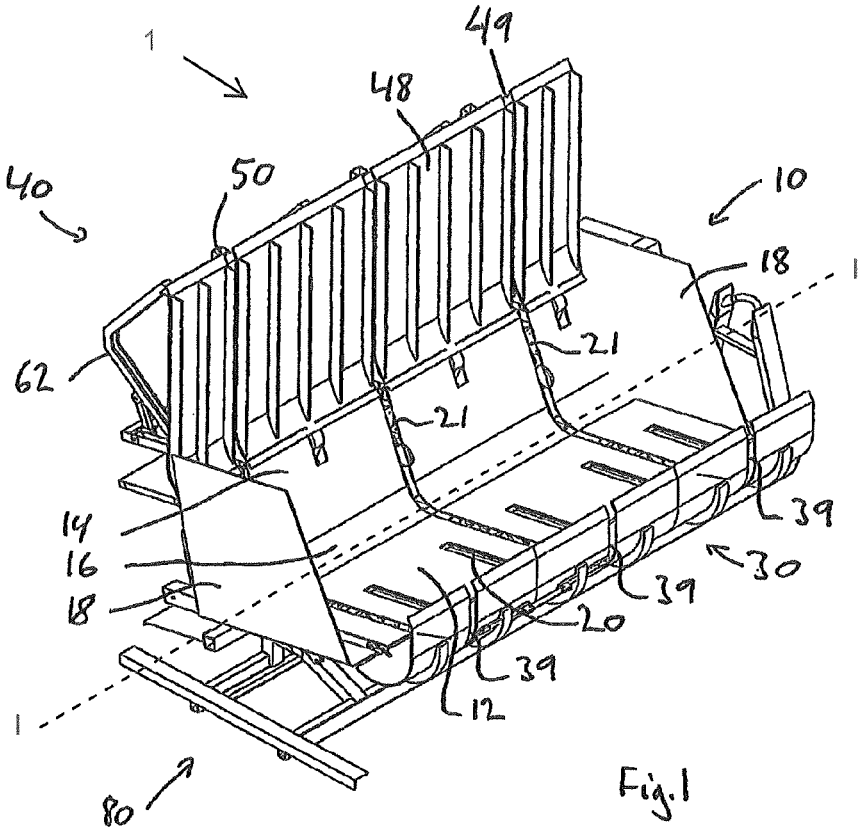
FIG. 1 is a perspective view from above of the device according to the invention where the compression means are open.

We now refer to the figures, where a compression device 1 comprises a container 10, first compression means 40, second compression means 30, bundling means 60 and a base 80. The base 80 will preferably be mounted on the load platform of a vehicle (not shown). In order to facilitate the description, the compression device 1 has a defined longitudinal axis I-I illustrated in FIG. 1.

The container 10 comprises a so-called bottom plate or substantially horizontal lower plate 12 and a so-called longitudinal side plate or substantially upwardly-facing plate 14 interconnected through a preferably curved plate portion 16. Both the upwardly-facing plate 14 and the lower plate 12 are attached to the base 80. The container comprises end walls 18 at each end, as illustrated in FIG. 1.

The lower plate 12 further comprises a number of tracks 20 perpendicular to the longitudinal axis I-I, whose function will become apparent from the description below.

The container 10 also comprises a number of slots 21 with closable covers (not shown) perpendicular to the longitudinal axis I-I, which are used in connection with the bundling operation, which will be described in more detail below.

The second compression means 30 comprises a moving device 32 mounted in respective tracks 20 in the lower plate 12. The moving device 32, for example in the form of an arm, has a spindle 34 about which the moving device 32 can be rotated relative to the base 80 by means of a drive device 36. Furthermore, the moving device 32 together with the spindle 34 can be moved in the longitudinal direction of the tracks 20 by means of a drive device (not shown). In this way the second compression means 30 carries out compression of the wood in a second direction, substantially horizontal in the figures.

Figure 3:
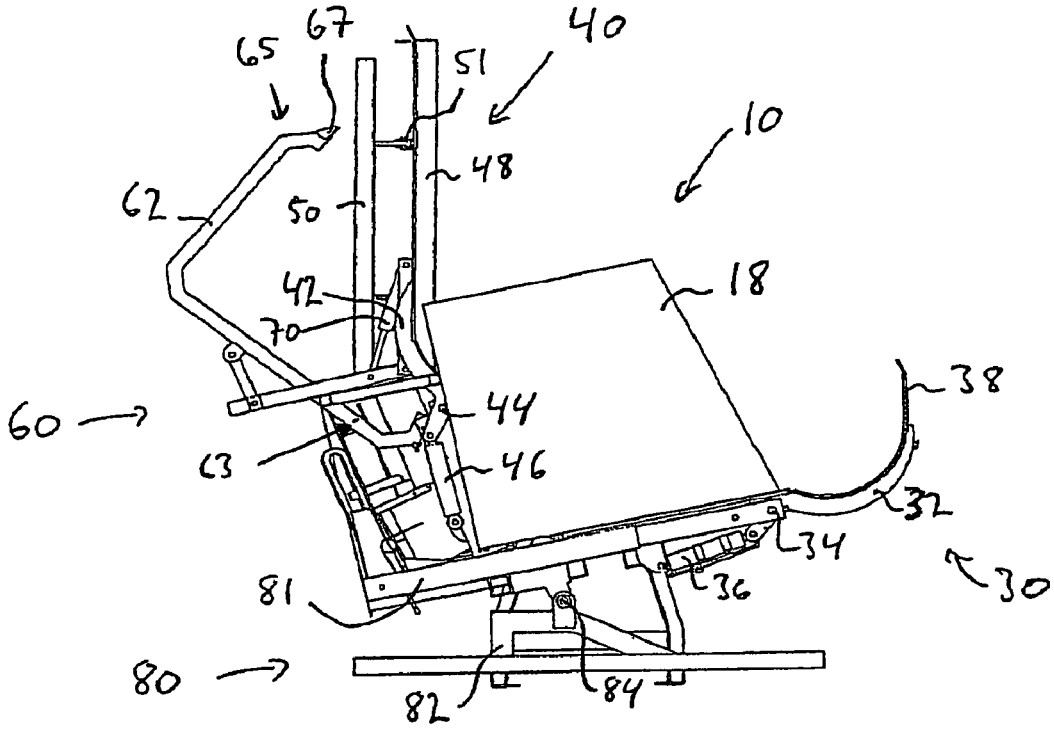
FIG. 3 illustrates the device in FIG. 1 viewed from the side.

The moving devices 32 support curved plates 38. Between the curved plates 38, slots 39 are provided perpendicular to the longitudinal axis I-I and matching the slots 21 in the container 10. It should be noted that the curved opening in respective curved plates 38 is facing the inside of the container 10, as illustrated in FIGS. 1 and 3.

Figure 4:
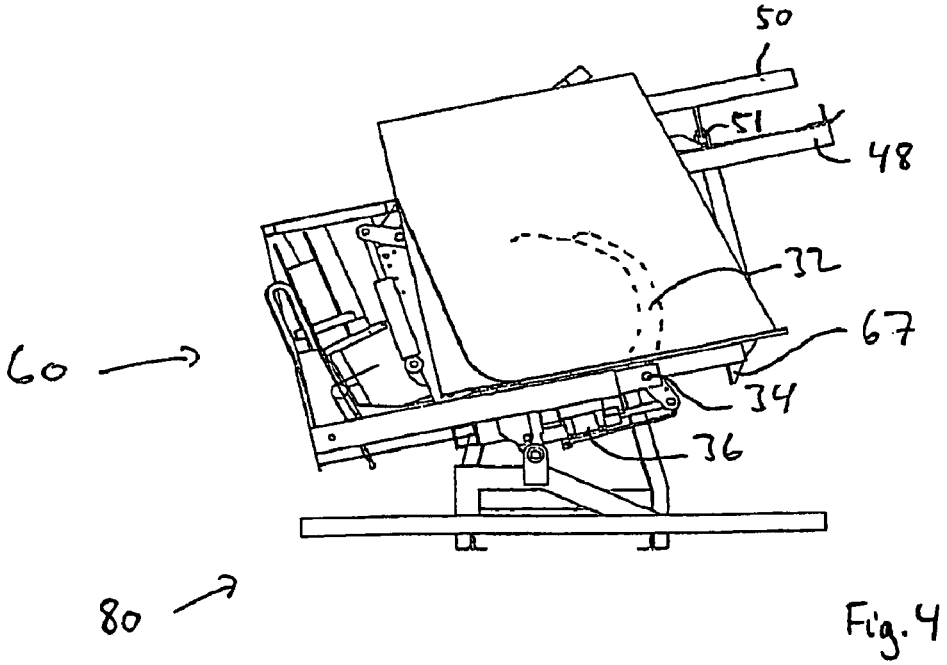
FIG. 4 illustrates the device in FIG. 2 viewed from the side.

The first compression means 40 also comprises a number of moving devices 42 which are rotatable about a spindle 44 by means of a drive device 46. The moving devices 42 are attached to a compression plate 48, which has a length that enables it to pass down between the end walls 18, as illustrated in FIG. 4. In this way the first compression means 40 carries out compression of the wood in a first direction, substantially vertical in the figures.

Figure 2:
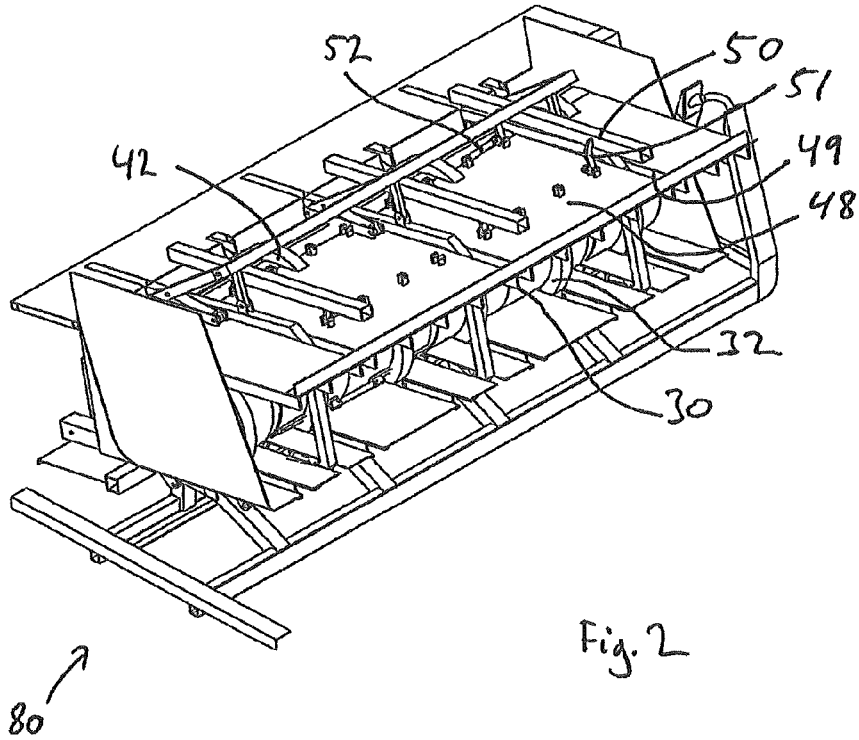
FIG. 2 illustrates the device in FIG. 1 where the compression means are closed.
Figure 6:
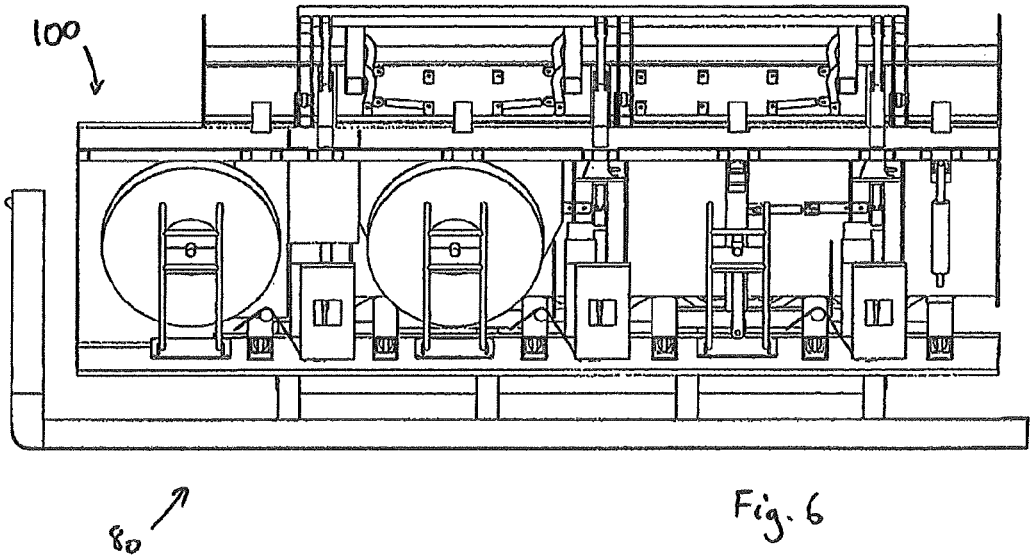
FIG. 6 illustrates the device in FIG. 2 viewed from behind.

In the compression plate 48 a number of slots 49 are provided perpendicular to the longitudinal axis I-I, matching the slots 21 in the container 10 and the slots 31. The slots 49 in the compression plate 48 are closable by means of covers 50 employed in connection with the bundling operation (FIG. 2). The covers 50 are preferably attached to the compression plate 48 by a hinged connection 51, and can be closed and opened by means of respective drive devices 52, as illustrated in FIG. 6.

It should be noted that the slots 21, 39 and 49 together form a guide track round the periphery of the container 10 for a strap (described in more detail below) which is used for bundling the wood. Some of, or preferably all of the slots 21, 39, 49 are closable by means of covers or other controllable closing devices, in order to prevent branches from being caught in the tracks, thereby ruining the bundling process.

The bundling means 60 will now be described with reference to FIGS. 3, 4 and 6. The bundling means 60 comprises a number of stays 62, which are attached at a lower end 63 to a strap drive device 64 mounted behind the substantially upwardly facing plate 14. The stay 62 is preferably positioned at such an angle that the stay 62 encircles the wood after the compression carried out by the first and second compression means 40, 30. As will be understood from the drawing, the purpose of the stay 62 is to secure the strap round the compressed wood. At its upper end 65, the stay 62 comprises a retainer body 67 for holding the end of the strap from the reel 66. A drive device 70 provides movement of the stay 62.

Figure 5:
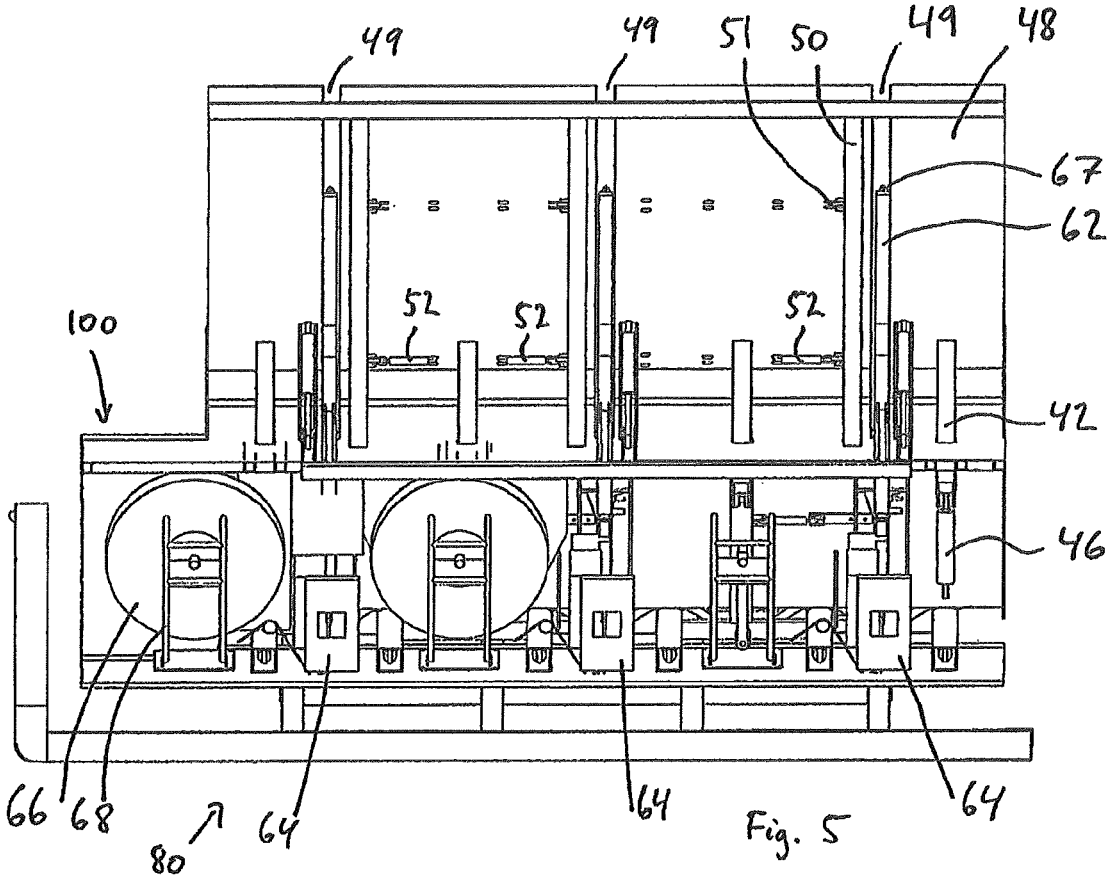
FIG. 5 illustrates the device in FIG. 1 viewed from behind.

For each stay 62 the bundling means 60 comprises a strap reel 66 with a strap, such as for example a plastic strap, which is used for the actual bundling process. The strap reel 66 is rotatably mounted to a support device 68. The support device 68 can be tilted from a substantially vertical operating position (shown in FIG. 6) to a substantially horizontal replacement position, thereby simplifying replacement of the strap reel 66. It should be noted that one of the reels 66 has been omitted in FIGS. 5 and 6.

The strap is passed from the strap reel 66 to the strap drive device 64 and then up to the retainer body 67 at the upper end 65 of the stay 62. The strap drive device 64 comprises a strap collecting body (not shown) for picking up the strap from the retainer body 67 after the stay 62 has secured the strap round the compressed wood, drive devices (not shown) for pulling and tightening the strap round the wood, together with a strap welding and cutting body (not shown) for welding and subsequent cutting of the strap after the end of the strap is fastened to the rest of the strap after it is pulled and tightened round the wood. This will also be apparent from the description below.

The base 80 comprises an upper frame 81 attached to respective plates 12, 14 in the container 10 and a lower frame 82 preferably adapted to be attached to a truck load platform, as mentioned at the beginning. The upper frame 81 is preferably securely attached to a shaft 84 parallel to the longitudinal axis I-I relative to the lower frame 82.

The said drive devices are preferably one or more hydraulic actuators, but electrical or pneumatic actuators may also be employed. The drive devices therefore also comprise a drive system, such as hydraulic pumps, hose connections, valves and the like, which are controlled by a control system. The control system is preferably operated by operating control means. This equipment is placed in a compartment 100 in the device 1.

Function

The function of the present invention will now be described with reference to the above description and attached figures.

In FIGS. 1 and 3 the initial position for the device is illustrated, i.e. the device is ready to be filled with wood. In this initial position first and second compression means 40, 30 are in their respective outermost positions, with the result that the opening in the container 10 is as large as possible. The slots 21 in the container 10 are closed, the slots 49 in the compression plate 48 are closed and the slots 39 in the plates 38 are preferably also closed.

In a first stage wood is filled in the container 10 to the desired level.

In a next stage the first compression means 40 is operated so as to move down towards the second compression means 30 by activating the drive device 46. The operation is performed until maximum compression force in the drive device 46 is achieved. The first compression means 40 is then preferably moved to an intermediate position.

In a next stage the second compression means 30 is operated up towards the first compression means 40 by means of the drive device 36, with the result that the top end of the plates 38 meets the bottom of the compression plate 48.

In a next stage the second compression means 30 is run along the track 22 by means of the said drive device (not shown), while the drive device 36 rotates the moving device 32 and the curved plates 38 further about the spindle 34, thereby achieving the position illustrated in FIG. 4.

The bundling process then begins. For this it is essential that the strap for bundling is already correctly inserted from the reel 66 via the strap drive device 64 into the retainer body 67 in the upper end 65 of the stay 62.

First of all the slots 21, 39, 49 are opened.

The stays 62 with respective retainer bodies 67 are then lowered into respective slots 21, 39, 49. The said strap collecting body pulls the end of the strap from the retainer body 67 into the strap drive device 64, whereupon the strap is pulled and tightened round the wood. The strap is then welded together and cut.

After the cutting operation the retainer body 67 in the stay 62 will preferably continue to hold what will be the new end of the strap. In this way, after returning to the initial position, the device 1 will be ready for a new compression and bundling operation. The operation will then be able to be repeated until the strap reels 66 are empty.

In a next stage the container 10 is opened by the stays 62 and first and second compression means 40, 30 being returned to initial positions. The compressed and bundled wood can be lifted out of the container 10.

The above detailed description is presented particularly with a view to illustrating and describing advantageous embodiments of the invention. The description, however, in no way limits the invention to the specific embodiments described in detail.

In the preferred embodiment above, a device is described with three stays 62 and respective tracks in the container 10, but it will of course be possible to vary this number on the basis of the size of the device and the desired area of application.

Alternative Embodiments

In the curved plate portion 16 there are preferably mounted ejector devices (not shown), capable of expelling the finished bundle of wood from the curved plate portion 16 in the container 10. This will facilitate lifting the bundle of wood out of the container 10.

The compression plates 38, 40 may of course be composed of several smaller plates.

The invention claimed is:

1. A wood compression device, comprising:

a container (10) with a bottom plate (12) and a longitudinal side plate (14);

first wood compression means (40) comprising a first compression plate (48) attached to a number of first moving devices (42) which are rotatable about a spindle (44) in the longitudinal side plate (14), where the first compression means (40) carries out compression of the wood in a first direction;

second wood compression means (30) comprising a second compression plate (38) attached to a number of second moving devices (32) which are rotatable about a spindle (34) in the bottom plate (12), where the second compression means (30) carries out compression of the wood in a second direction; where a number of slots (21) are provided in the container (10), a number of slots (49) in the first compression means (30) and a number of slots (39) in the second compression means (40), where the slots (21, 39, 49) are located in the same plane across the container's (10) longitudinal axis (I-I); and where the device (1) further comprises:

bundling means (60) for applying and fastening a strap round the compressed wood through respective slots (21, 39, 49).

2. A wood compression device according to patent claim 1, characterised in that the bottom plate (12) and the side plate (14) are connected by a substantially curved plate portion (16).

3. A wood compression device according to patent claim 1, characterised in that the container (10) comprises end plates (18) at respective ends.

4. A wood compression device according to patent claim 1, characterised in that the container (10) further comprises tracks (20) across the longitudinal axis I-I, where the second compression means (30) is movable in the longitudinal direction of the tracks (20) for further compression of the wood.

5. A wood compression device according to patent claim 1, characterised in that the slots (21) in the container (10) are closable by means of covers during compression.

6. A wood compression device according to patent claim 1, characterised in that the first compression means, the second compression means and the bundling means are controllably driven by drive devices such as hydraulic, pneumatic and/or electrical actuators.

7. A wood compression device according to patent claim 1, characterised in that the container (10) is mounted on a base (80), adapted to be mounted on a vehicle or a vehicle trailer.

* * * * *